US008192221B2

(12) United States Patent
Schmettkamp et al.

(10) Patent No.: US 8,192,221 B2
(45) Date of Patent: Jun. 5, 2012

(54) PRINTED BOARD CONNECTOR WITH LOCKING DEVICE

(75) Inventors: Heinrich Schmettkamp, Moers (DE); Christian Schuetz, Hille (DE)

(73) Assignee: Harting Electronics GmbH & Co. KG (DE)

( * ) Notice: Subject to any disclaimer, the term of this patent is extended or adjusted under 35 U.S.C. 154(b) by 0 days.

(21) Appl. No.: 12/955,623

(22) Filed: Nov. 29, 2010

(65) Prior Publication Data

US 2011/0136367 A1 Jun. 9, 2011

(51) Int. Cl.
*H01R 13/62* (2006.01)

(52) U.S. Cl. ..... 439/345

(58) Field of Classification Search ..... 439/345, 439/74, 894, 59, 357; 29/738, 758; 361/818
See application file for complete search history.

(56) References Cited

U.S. PATENT DOCUMENTS

| | | | | |
|---|---|---|---|---|
| 4,637,670 | A * | 1/1987 | Coller et al. | 439/180 |
| 5,567,166 | A * | 10/1996 | Lemke | 439/74 |
| 5,836,773 | A * | 11/1998 | McHugh et al. | 439/74 |
| 6,220,903 | B1 * | 4/2001 | Huang | 439/894 |
| 2004/0058568 | A1 | 3/2004 | Ye et al. | 439/74 |

FOREIGN PATENT DOCUMENTS

| | | |
|---|---|---|
| EP | 1557908 | 7/2005 |
| EP | 1624535 B1 | 10/2007 |

OTHER PUBLICATIONS

European Search Report issued in Application No. EP 10 01 5559 dated Mar. 2, 2011 (1 pg).
German Search Report issued in Application No. 10 2009 058 616. 4-34 dated Oct. 26, 2010 (3 pgs).

* cited by examiner

*Primary Examiner* — Alexander Gilman
(74) *Attorney, Agent, or Firm* — Hayes Soloway P.C.

(57) ABSTRACT

In order to simplify the assembly of a shielded connector, it is proposed that an electrically insulating base body provided as a carrier for electric contacts features a mounting surface with two openings, wherein a recess that respectively features an integral collar on its inner side is respectively arranged around these openings.
In addition, the base body is provided with lateral fastening elements that respectively feature a window formed by a frame. The frame can be positively fitted into the appropriate recess by bending the fastening elements such that the fastening element is positively and non-positively fixed on the base body.
An electrically conductive shielding element that largely surrounds the base body contacts the fastening elements that, in turn, contact ground strips on the circuit board such that the connector is shielded from external voltages.

22 Claims, 6 Drawing Sheets

PRINTED BOARD CONNECTOR WITH LOCKING DEVICE

BACKGROUND OF THE INVENTION

1. Field of the Invention

The invention pertains to a printed board connector for parallel printed boards, wherein the printed board connector consists of a first connector part and a second connector part, wherein the first connector part features a first base surface that can be fixed on a first printed board and the second connector part features a second base surface that can be fixed on a second printed board, and wherein the first connector part features a first locking element and the second connector part features a second locking element.

A device of this type is required for electrically and mechanically interconnecting two printed boards that are aligned parallel to one another and respectively fixed on a connector part, as well as for locking this connection.

2. Description of the Related Art

A printed board connector for locking printed boards that are aligned parallel to one another is known from publication EP 1 624 535 B1. The printed board connector consists of two connectors and features locking means for blocking a vertical movement of its cover housings. The printed board connector furthermore features unlocking means for unlocking the cover housings.

One disadvantage of the state of the art can be seen in that there exists no printed board connector of the initially cited type that can be cost-effectively manufactured and is suitable for easily unlocking an existing lock between two printed boards that are aligned parallel to one another.

SUMMARY OF THE INVENTION

The invention therefore is based on the objective of realizing a printed board connector of the initially cited type in such a way that it allows a simple unlocking of the printed boards and furthermore can be cost-effectively manufactured.

This objective is attained in that both locking elements respectively feature at least one locking arm, in that at least one integral moulding that respectively features a locking surface is provided on the end of each locking arm, and in that the locking surfaces of both locking elements are arranged such that they interengage in the locked state.

Such a printed board connector makes it possible to lock and unlock two parallel printed boards in a particularly convenient fashion.

At least one of the two locking elements consists at least partially of an elastically deformable material. The printed board connector furthermore features an unlocking element that is designed for elastically deforming at least one of the two locking elements in order to separate the locking surfaces of both locking elements from one another. The unlocking element can be advantageously moved perpendicular to the first base surface on the first connector part and is connected thereto in a captive fashion, for example, by providing the unlocking element with unlocking arms that are guided through corresponding openings in the first base surface in a form-fitting but movable fashion. Due to integral mouldings on the ends of the unlocking arms, the unlocking element is connected to the first connector part in a captive fashion. It is furthermore particularly advantageous that no additional parts are required such that no hardware can be lost.

One significant advantage attained with the invention can be seen in that the respective locking element is only elastically deformed during the locking and unlocking processes, i.e., the respective locking element is not deformed in the locked and the unlocked state and therefore not subjected to corresponding mechanical stresses over an extended period of time. This has advantageous effects on the service life of the locking element in accordance with the respective material.

Another advantage is that the assembly and disassembly of the printed boards can be carried out without an additional tool. The locking process and the unlocking process are significantly simplified in comparison with the state of the art. The printed board connector can also be cost-effectively manufactured.

It is particularly advantageous if the locking surfaces of the locking elements are arranged nearly parallel to the corresponding base surfaces. In this context, the term "nearly parallel" means that an angle between the plane of the locking surface and a plane that lies parallel to the corresponding base surface is not greater than 10°, particularly not greater than 5°. The nearly parallel alignment of the locking surfaces ensures that the locking elements do not unlock themselves independently and that they can already be unlocked with relatively low force components that act parallel to the printed board plane.

These force components are generated by the unlocking element that is moved perpendicular to the printed board plane. The unlocking element is realized in a U-shaped fashion in this case. The second locking element consists of an elastically deformable material and is advantageously realized in a V-shaped fashion. It is furthermore particularly advantageous if the integral mouldings of the second locking element feature engagement bevels that serve for cooperating with the unlocking element during the unlocking process. During the insertion into the printed board connector, the unlocking element presses together the two locking arms of the second locking element with the aid of the said engagement bevels. In this case, the V-shape of the second locking element is particularly advantageous because its two locking arms can be moved toward one another with only a slight elastic dew formation and with a relatively low expenditure of force due to the corresponding lever effect.

It is furthermore particularly advantageous that the locking elements are situated within the connector and therefore protected from mechanical damages, as well as unintentional unlocking.

The unlocking element is advantageously realized in the form of a user-friendly actuator that extends through the first base surface and a first printed board fixed thereon in corresponding openings and thusly makes it possible to easily unlock the two connector parts. In this way, the printed boards fixed on the two base surfaces can be unlocked externally, i.e., from the side of the first printed board that faces away from the connector, by simply pressing the unlocking element into the connector.

In another embodiment, the second locking element features a locking arm with two integral mouldings. Due to these integral mouldings, the second locking element is essentially realized in a T-shaped fashion. This is advantageous because the retention forces consequently extend parallel to its locking arm. The first locking element also consists of an elastically deformable material and is essentially realized in a U-shaped fashion, wherein the corresponding integral mouldings are directed inward, i.e., toward one another, in order to interlock with the integral mouldings of the second locking element. The integral mouldings of the first locking element furthermore feature engagement bevels that are designed for cooperating with the second locking element during the locking process. However, these engagement bevels are also provided for cooperating with the unlocking element during the unlocking process as follows: in the locked state, the unlocking element encompasses the first locking element. During the unlocking process, the engagement bevels of the integral mouldings of the first locking element are acted upon by unlocking hooks that are integrally moulded on the unlocking element, particularly by corresponding unlocking bevels, when the unlocking element is partially pulled out. This causes the locking arms of the second locking element to be pulled apart. Consequently, the locking surfaces of both locking elements are separated from one another and the two connector parts are unlocked.

It is particularly advantageous that the moving direction of the unlocking element during the unlocking process coincides with the moving direction of the first connector part during the separation from the second connector part. This significantly improves the manual handling because the moving direction for the unlocking process and the moving direction for the separation of the connector parts are identical such that no oppositely directed force components occur.

BRIEF DESCRIPTION OF THE DRAWINGS

A first exemplary embodiment of the invention is illustrated in the drawings in FIG. 1*a* to FIG. 4*b*. In these drawings.

Figure 1A:
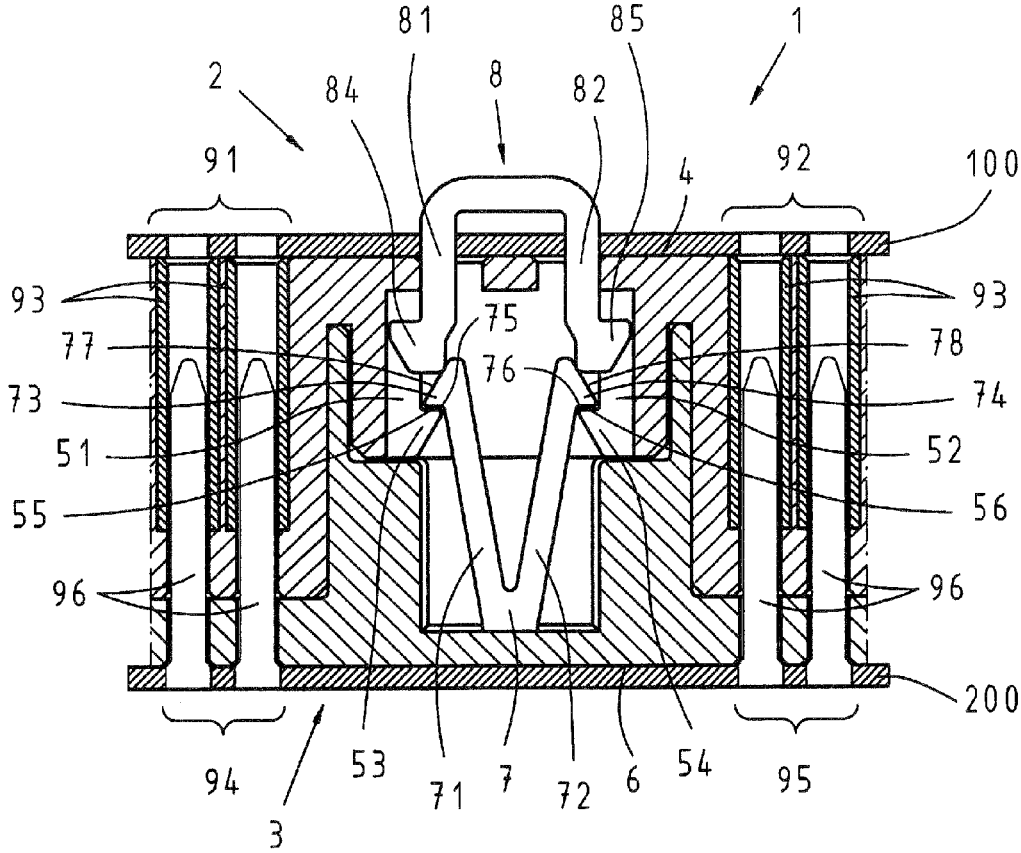
FIG. 1*a* shows a cross section through a locked printed board connector.
Figure 5A:
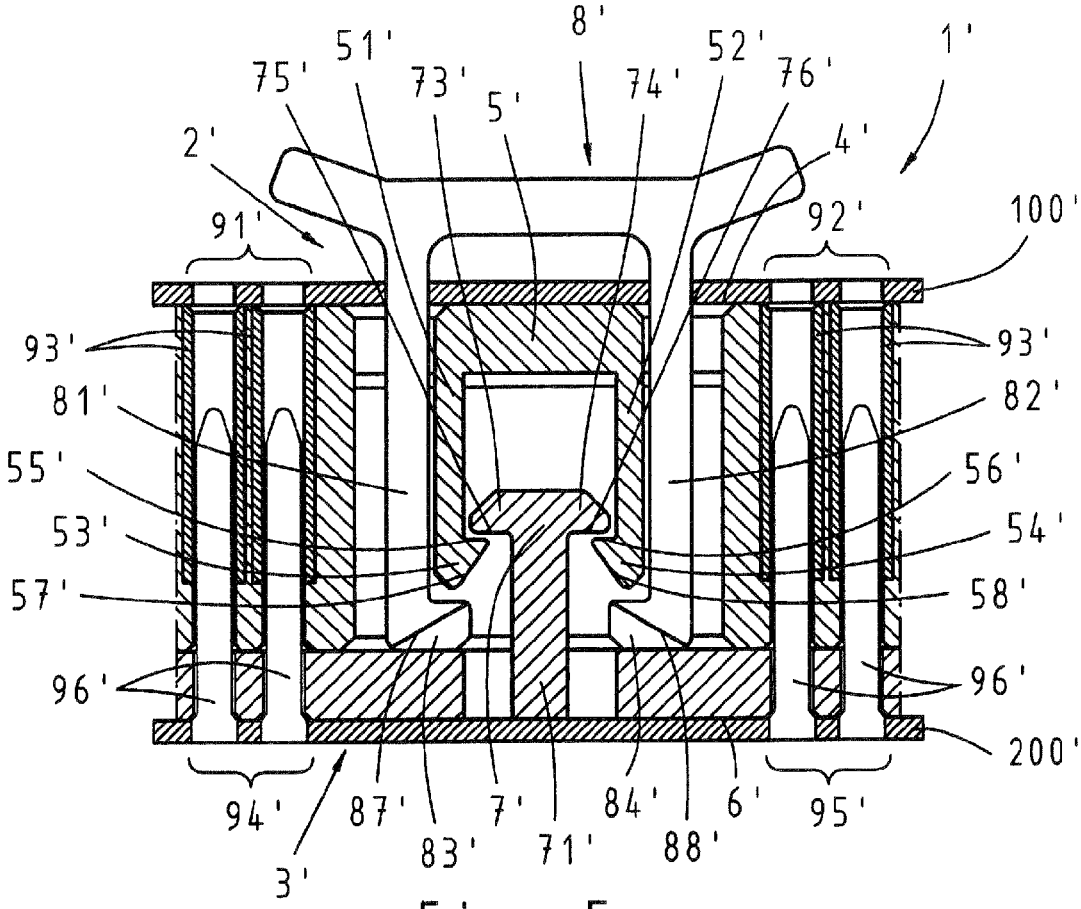
Figure 5B:
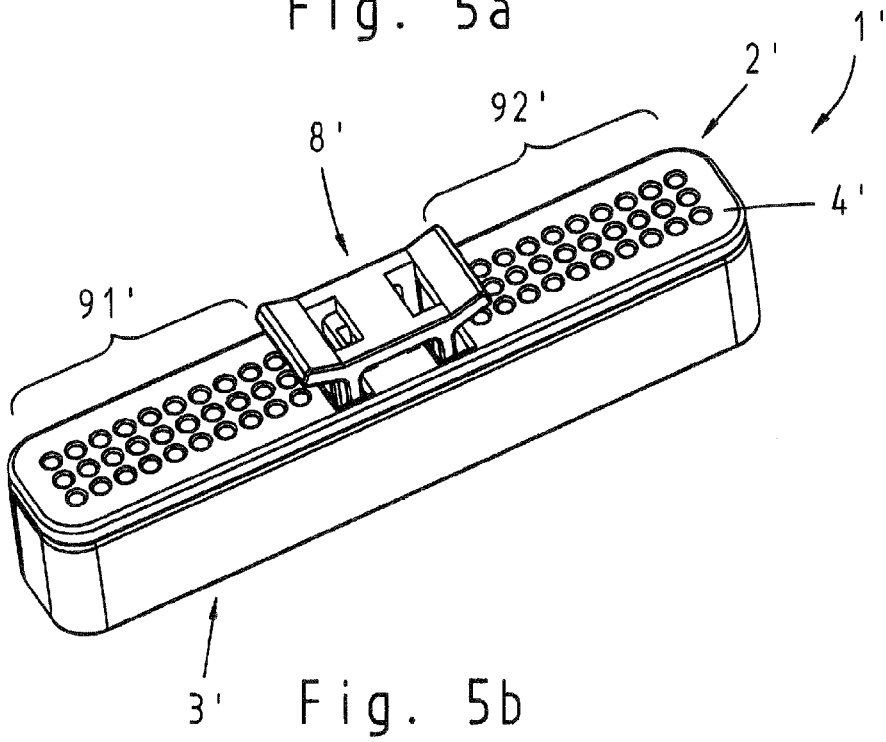
Figure 6A:
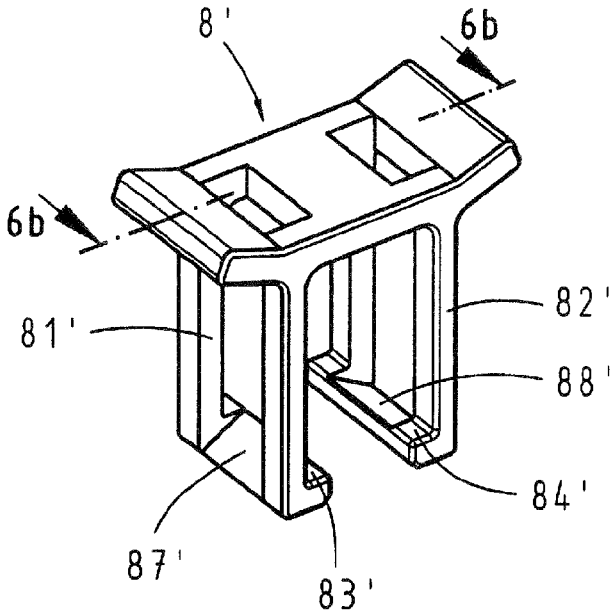
Figure 6B:
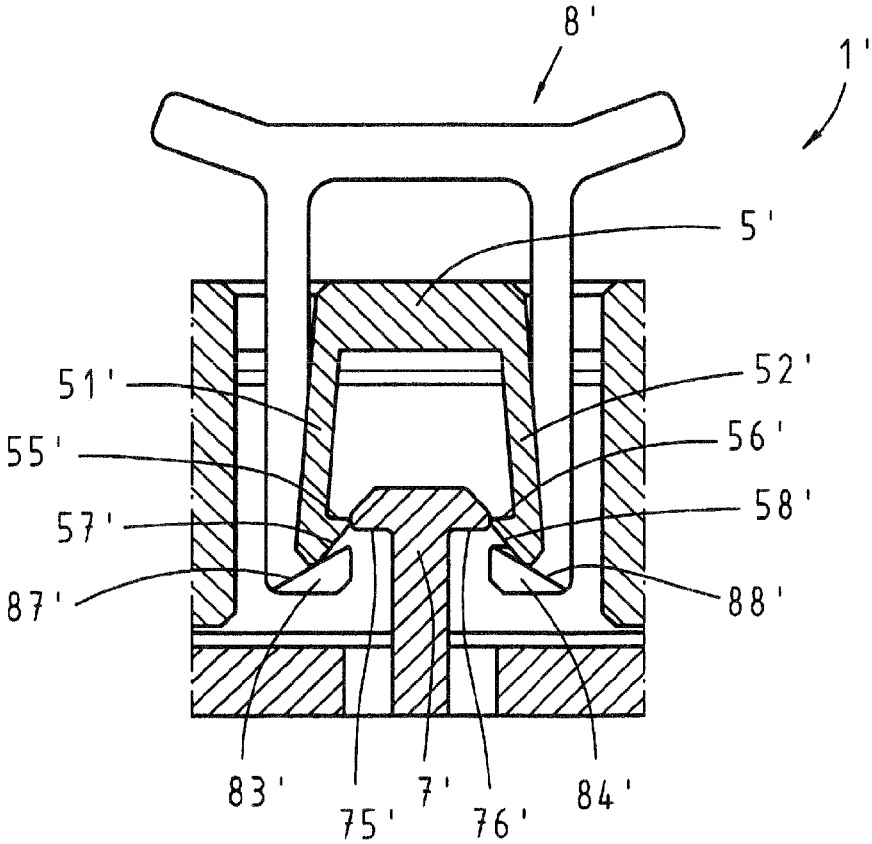

A second exemplary embodiment is illustrated in the drawings in FIG. 5*a* to FIG. 6*b*. In these drawings:

FIG. 5*a* shows a cross section through a locked printed board connector,

FIG. 5*b* shows a three-dimensional representation of the locked printed board connector, FIG. 6*a* shows a three-dimensional representation of an unlocking element, and FIG. 6*b* shows a cross section through the printed board connector during the unlocking process.

DESCRIPTION OF THE PREFERRED EMBODYMENTS

First Exemplary Embodiment

FIG. 1*a* shows a locked printed board connector 1 in the form of a cross section through a locking plane. This locking plane is characterized in that it perpendicularly intersects locking surfaces 55, 56, 75, 76 that are described further below such that the locking and unlocking mechanism of the printed board connector 1 is visible in the figure. The printed board connector 1 consists of a first connector part 2 and a second connector part 3. The first connector part 2 has a first base surface 4, by means of which it is fixed on a first printed board 100. The second connector part 2 has a second base surface 6, by means of which it is fixed on a second printed board 200. The two connector parts 2, 3 are interlocked such that their base surfaces 4, 6 are is aligned parallel to one another and therefore mechanically connect the parallel printed boards 100, 200 fixed thereon to one another.

Figure 1B:
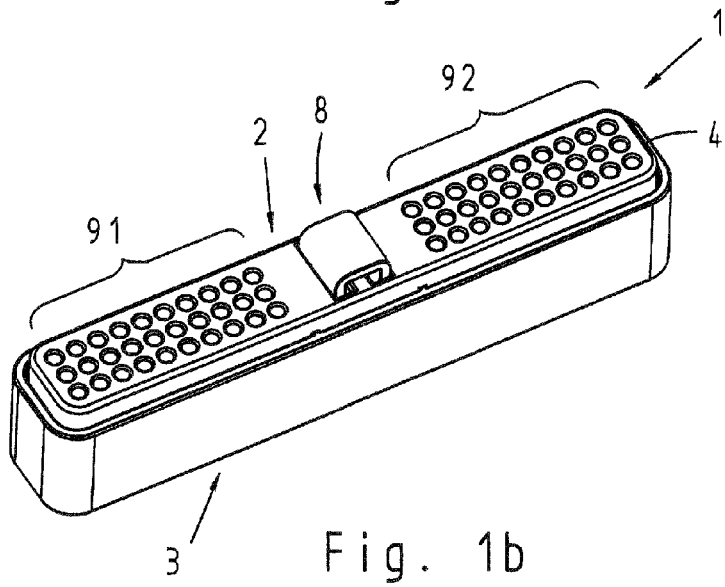
FIG. 1*b* shows a three-dimensional representation of the locked printed board connector.

FIG. 1*b* shows the locked printed board connector in the form of a three-dimensional exterior view. The first connector part 2 is illustrated as an individual component, namely in the form of a cross section through the locking plane in FIG. 2*a* and in the form of a three-dimensional exterior view in FIG. 2*b*. The first connector part 2 features a first locking element 5 that is realized in two pieces, namely in the form of two separate locking arms 51, 52 with corresponding integral mouldings 53, 54. The first locking element 5 accordingly is not identified as an individual component in the drawings. The second connector part 3 is illustrated similarly in FIG. 3*a* and FIG. 3*b* and features a second locking element 7 that is realized in one piece.

Figure 2A:
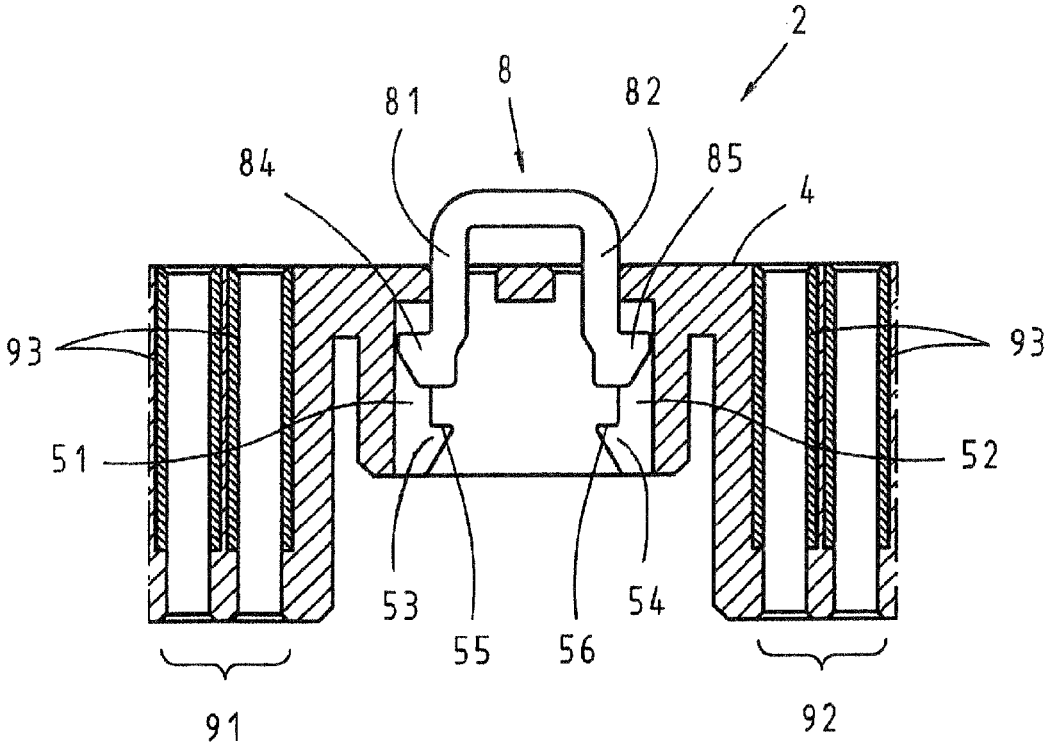
FIG. 2*a* shows a cross section through a first connector part.

According to FIG. 2*a*, the two locking arms 51, 52 of the first locking element 5 are aligned parallel to one another and feature corresponding integral mouldings 53, 54 on their ends. The integral mouldings 53, 54 are directed inward, i.e., toward one another, and respectively feature a locking surface 55, 56 that is aligned parallel to the first base surface 4. The first connector part 2 furthermore features two mating areas 91, 92 that are equipped with contact sockets 93.

Figure 3A:
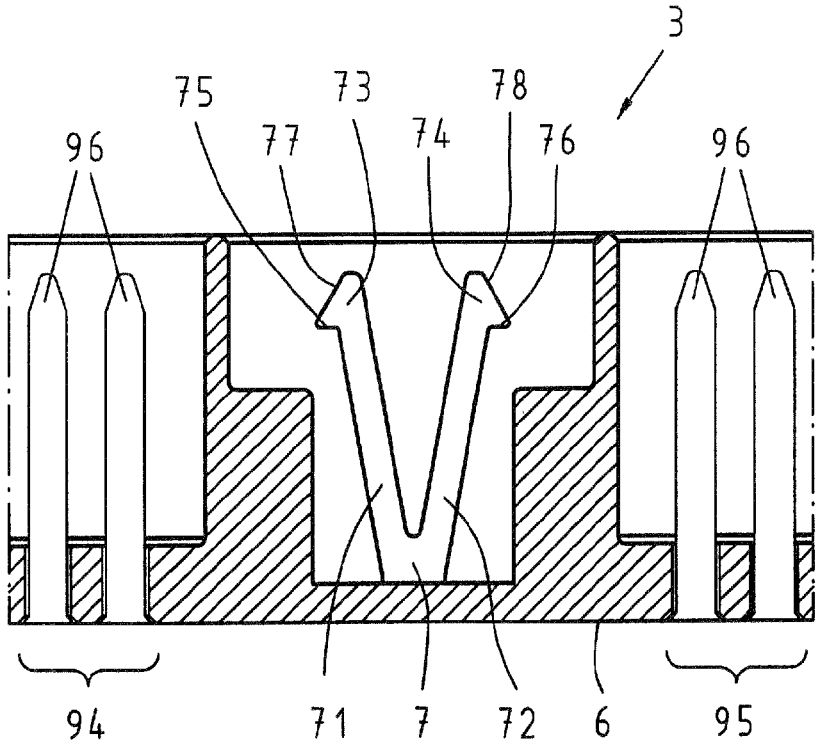
FIG. 3*a* shows a cross section through a second connector part.
Figure 3B:
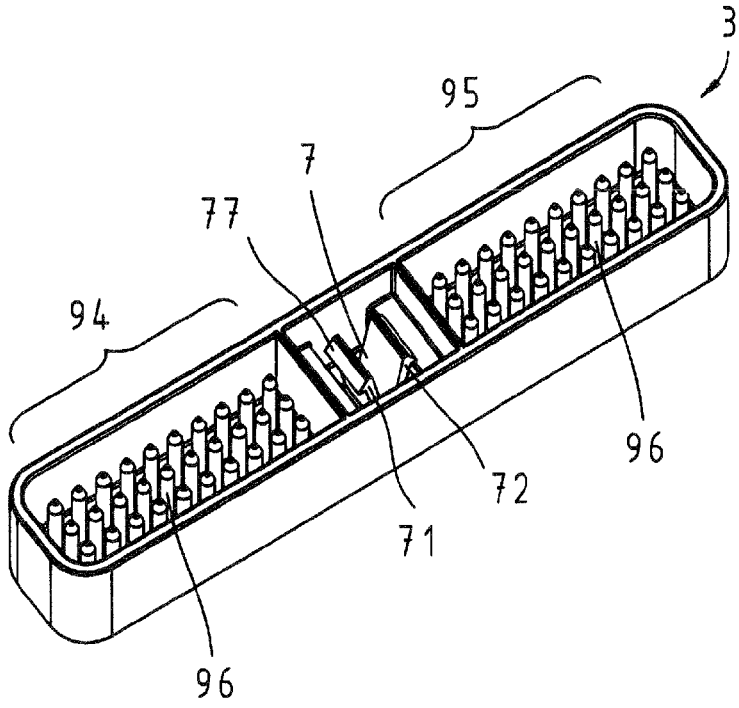
FIG. 3*b* shows a three-dimensional representation of the second connector part.

The second locking element 7 illustrated in FIG. 3*a* consists of an elastically deformable material and is essentially realized in a V-shaped fashion with two corresponding locking arms 71, 72. These locking arms 71, 72 respectively feature an integral moulding 73, 74 on their ends. These two integral mouldings 73, 74 are directed outward, i.e., away from one another, and respectively feature a locking surface 75, 76 that is aligned parallel to the to second base surface 6. These two integral mouldings 73, 74 furthermore feature engagement bevels 77, 78 on the side that faces away from the respective locking surface 75, 76. The second connector part furthermore features two mating areas 94, 95 that are equipped with contact pins 96.

During the interlocking of the two connector parts 2, 3, the integral mouldings 53, 54 of the two locking arms 51, 52 of the first locking element 5 press together the locking arms 71, 72 of the second locking element 7 with the aid of its engagement bevels 77, 78. During the further insertion, the locking arms 51, 52, 71, 72 of the two locking elements 5, 7 interlock with their integral mouldings 53, 54, 73, 74. In the locked state, the locking surfaces 55, 56 of the first locking element 5 and the locking surfaces 75, 76 of the second locking element 7 are then arranged in an interengaging fashion as already illustrated in FIG. 1*a*.

Figure 2B:
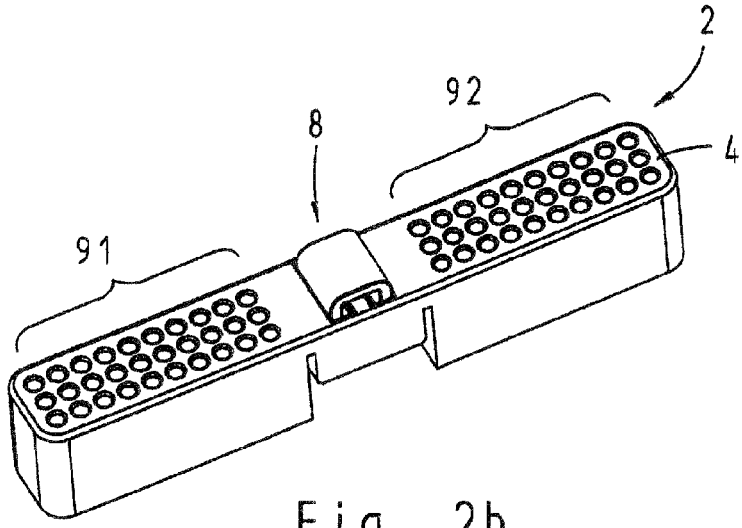
FIG. 2*b* shows a three-dimensional representation of the first connector part.
Figure 4A:
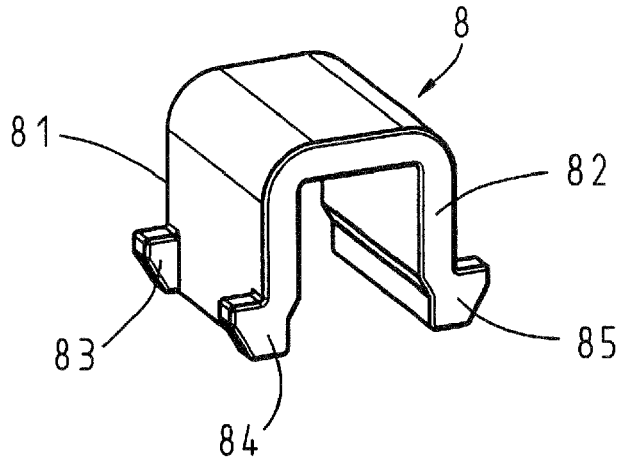
FIG. 4*a* shows a three-dimensional representation of an unlocking element.

A U-shaped locking element 8 is illustrated in the form of an individual component in FIG. 4*a*, namely in the form of a three-dimensional representation. This unlocking element 8 features two unlocking arms 81, 82 that are movably guided through corresponding openings in the first base surface 4 as illustrated in FIG. 1*b* and FIG. 2*b*. Integral mouldings 83, 84, 85, 86 are provided on the ends of the unlocking arms 81, 82, wherein only three integral mouldings 83, 84, 85 are visible in the drawings while the fourth integral moulding 86 is covered by the second unlocking arm 82 and accordingly not identified in the drawing. The unlocking element 8 is connected to the first connector part 2 in a captive fashion due to these integral mouldings 83, 84, 85, 86. The unlocking element 8 forms a component of the first connector part 2.

Figure 4B:
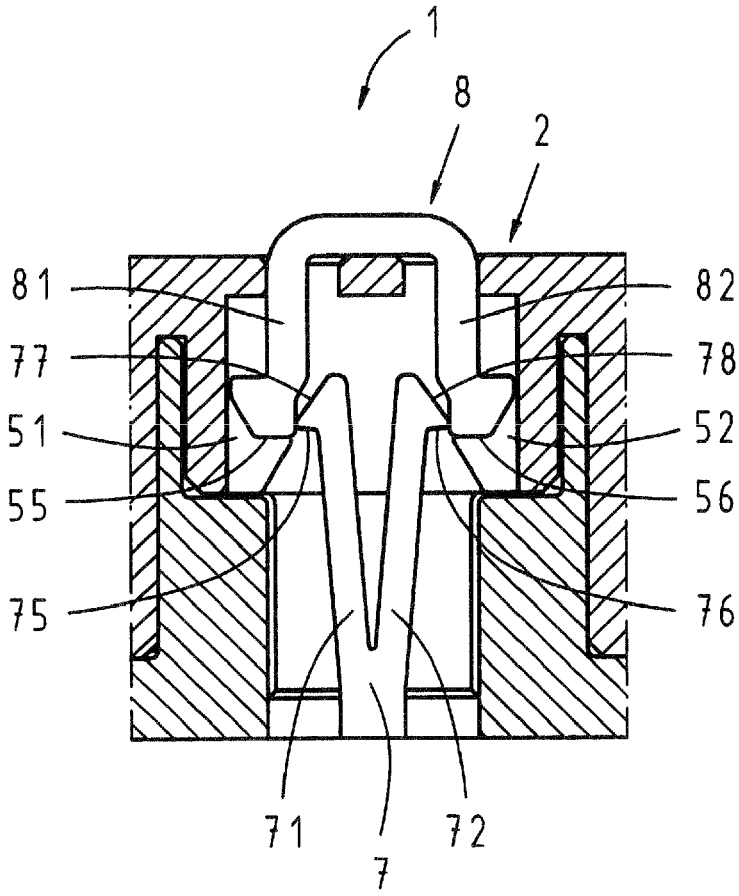
FIG. 4*b* shows a cross section through the printed board connector during the unlocking process.

The corresponding unlocking process is illustrated in FIG. 4*b*. When the unlocking element 8 is inserted into the originally locked printed board connector 1, the unlocking arms 81, 82 press against the engagement bevels 77, 78 of the second locking element 7 and elastically bent together its locking arms 71, 72. The locking surfaces 75, 76 of the second locking element 7 are separated from the locking surfaces 55, 56 of the first locking element in this fashion and the printed board connector 1 is unlocked.

Second Exemplary Embodiment

FIG. 5*a* and FIG. 5*b* show a locked printed board connector 1' that consists of two connector parts 2', 3' with printed boards 100', 200' fixed thereon. FIG. 5*a* shows this arrangement in the form of a cross section through a locking plane. FIG. 5*b* shows the arrangement in the form of a three-dimensional exterior view.

The first connector part 2' features a first base surface 4' and a first locking element 5' that is integrally moulded on the first base surface 4'. The first locking element 5' is realized in one piece. The second connector part 3' features a second base surface 6' and a second locking element 7' that is integrally moulded on the second base surface 6'. The second locking element 7' is realized in one piece.

The first locking element 5' consists of an elastically deformable material and is essentially realized in a U-shaped fashion with two locking arms 51', 52'. The first locking element 5' features two integral mouldings 53', 54' on the ends of the two locking arms 51', 52'. These integral mouldings 53', 54' respectively feature a locking surface 55' 56' that is aligned parallel to the first base surface 4'. These two integral mouldings 53', 54' furthermore feature engagement bevels 57', 58' on the side that faces away from their respective locking surface 55', 56'. The first connector part 2' furthermore features two mating areas 91', 92' that are equipped with contact sockets 93'.

FIG. 5*a* furthermore shows that the second locking element 7' features a locking arm 71' that is integrally moulded on the second base surface 6 on one end and provided with one respective integral moulding 73', 74' to both sides on the other end. Due to these two integral mouldings 73', 74', the second locking element 7' is essentially realized in a T-shaped fashion. The two integral mouldings 73', 74' respectively feature a locking surface 75', 76' that is aligned parallel to the second base surface 6'. The second connector part 3' furthermore features two mating areas 94', 95' that are equipped with contact pins 96'.

During the locking process, the engagement bevels 57', 58' of the first locking element 5' press against the integral mouldings 73', 74' of the second locking element. In this way, the locking arms 51', 52' of the first locking element 5' initially are elastically bent apart and then interlock with the locking surfaces 75', 76' of the second locking element 7' during the further insertion. In the locked state, the locking surfaces 55', 56' of the first locking element 5' and the locking surfaces 75', 76' of the second locking element 7' consequently are arranged in an interengaging fashion.

The first connector part 2' furthermore features an essentially U-shaped unlocking element 8' that is illustrated as an individual component in FIG. 6*a*. This three-dimensional representation elucidates that the unlocking element 8' has two plane unlocking arms 81', 82' that extend parallel to one another and respectively feature a rectangular window. An unlocking hook 83', 84' with an unlocking bevel 87', 88' respectively is integrally moulded on the end of each unlocking arm 81', 82' as the lower edge of the window. The unlocking arms 81', 82' of the unlocking element 8' extend through the first base surface 4' in corresponding openings as illustrated in FIG. 5*b*. Consequently, the unlocking element 8' can be moved perpendicular to the first base surface 4' and is held on the first connector part 2' in a captive fashion. The unlocking element 8' forms a component of the first connector part 2'. The unlocking arms 81', 82' also extend through a first printed board 100' that is fixed on the first base surface 4' in corresponding openings. The illustration in FIG. 5*a* furthermore elucidates that the unlocking element 8' encompasses the first locking element 5' with its unlocking arms 81', 82' and its unlocking hooks 83', 84' in the locked state.

FIG. 6*b* shows the unlocking process in the form of a cross section through a locking plane that is indicated in FIG. 6*a*: when the unlocking element 8' is partially pulled out of the printed board connector 1', the unlocking hooks 83', 84' press against the engagement bevels 57', 58' of the first locking element 5' with their unlocking bevels 87', 88'. This causes the two locking arms 51', 52' of the first locking element 5' to be elastically bent apart. In this way, the locking surfaces 55', 56' of the first locking element 5' are separated from the locking surfaces 75', 76' of the second locking element 7' and the printed board connector 1' is unlocked.

The two connector parts 2', 3' are separated from one another after the unlocking process by continuing to pull on the unlocking element 8' or on the first connector part 2'. Consequently, only a single movement/moving direction is required for simultaneously unlocking and separating the two connector parts 2', 3'. Oppositely directed force components do not occur during this process.

What is claimed is:

1. A printed board connector for parallel printed boards, wherein the printed board connector consists of a first connector part and a second connector part wherein the first connector part features a first base surface that can be fixed on a first printed board and the second connector part features a second base surface that can be fixed on a second printed board, and wherein the first connector part features a first locking element and the second connector part features a second locking element, wherein that both locking elements respectively feature at least one locking arm in that at least one integral moulding that respectively features a locking surface is provided on the end of each locking arm, and in that the locking surfaces of both locking elements are arranged such that they interengage in the locked state, wherein at least one of the two locking elements consists at least partially of an elastically deformable material, and wherein the first connector part features an unlocking element that is held on the first connector part such that it can be moved perpendicular to the first base surface and therefore is suitable for elastically deforming at least one of the two locking elements in order to separate the locking surfaces of the first locking element from the locking surfaces of the second locking element.

2. The printed board connector according to claim 1, wherein the unlocking element is connected to the first connector part in a captive fashion.

3. The printed board connector according to claim 1, wherein the locking surfaces are aligned nearly parallel to the base surfaces of the respective connector part.

4. The printed board connector according to claim 1, wherein the first locking element features two parallel locking arms with integral mouldings that are directed toward one another.

5. The printed board connector according to claim 1, wherein the second locking element is essentially realized in a V-shaped fashion and features two locking arms with integral mouldings that are directed away from one another.

6. The printed board connector according to claim 1, wherein the second locking element features a locking arm with two integral mouldings, wherein the second locking element with its integral mouldings is essentially realized in a T-shaped fashion.

7. The printed board connector according to claim 1, wherein the integral mouldings of at least one of the two locking elements feature engagement bevels that are designed for cooperating with the unlocking element.

8. The printed board connector according to claim 1, wherein the unlocking element is essentially realized in a U-shaped fashion.

9. A printed board connector for parallel printed boards, wherein the printed board connector consists of a first connector part and a second connector part wherein the first connector part features a first base surface that can be fixed on a first printed board and the second connector part features a second base surface that can be fixed on a second printed board, and wherein the first connector part features a first locking element and the second connector part features a second locking element, wherein that both locking elements respectively feature at least one locking arm in that at least one integral moulding that respectively features a locking surface is provided on the end of each locking arm, and in that the locking surfaces of both locking elements are arranged such that they interengage in the locked state, wherein the second locking element is essentially realized in a V-shaped fashion and features two locking arms with integral mouldings that are directed away from one another.

10. The printed board connector according to claim 9, wherein at least one of the two locking elements consists at least partially of an elastically deformable material.

11. The printed board connector according to claim 9, wherein the unlocking element is connected to the first connector part in a captive fashion.

12. The printed board connector according to claim 9, wherein the locking surfaces are aligned nearly parallel to the base surfaces of the respective connector part.

13. The printed board connector according to claim 9, wherein the first locking element features two parallel locking arms with integral mouldings that are directed toward one another.

14. The printed board connector according to claim 9, wherein the integral mouldings of at least one of the two locking elements feature engagement bevels that are designed for cooperating with the unlocking element.

15. The printed board connector according to claim 9, wherein the unlocking element is essentially realized in a U-shaped fashion.

16. A printed board connector for parallel printed boards, wherein the printed board connector consists of a first connector part and a second connector part wherein the first connector part features a first base surface that can be fixed on a first printed board and the second connector part features a second base surface that can be fixed on a second printed board, and wherein the first connector part features a first locking element and the second connector part features a second locking element, wherein that both locking elements respectively feature at least one locking arm in that at least one integral moulding that respectively features a locking surface is provided on the end of each locking arm, and in that the locking surfaces of both locking elements are arranged such that they interengage in the locked state, wherein the second locking element features a locking arm with two integral mouldings, wherein the second locking element with its integral mouldings is essentially realized in a T-shaped fashion.

17. The printed board connector according to claim 16, wherein at least one of the two locking elements consists at least partially of an elastically deformable material.

18. The printed board connector according to claim 16, wherein the unlocking element is connected to the first connector part in a captive fashion.

19. The printed board connector according to claim 16, wherein the locking surfaces are aligned nearly parallel to the base surfaces of the respective connector part.

20. The printed board connector according to claim 16, wherein the first locking element features two parallel locking arms with integral mouldings that are directed toward one another.

21. The printed board connector according to claim 16, wherein the integral mouldings of at least one of the two locking elements feature engagement bevels that are designed for cooperating with the unlocking element.

22. The printed board connector according to claim 16, wherein the unlocking element is essentially realized in a U-shaped fashion.

* * * * *